US007992468B2

(12) United States Patent
Jones

(10) Patent No.: US 7,992,468 B2
(45) Date of Patent: Aug. 9, 2011

(54) INTERNALLY FITTING TOOL FOR SPINNING A HOLLOW ELEMENT

(76) Inventor: Dustin Jones, Herscher, IL (US)

( * ) Notice: Subject to any disclaimer, the term of this patent is extended or adjusted under 35 U.S.C. 154(b) by 176 days.

(21) Appl. No.: 12/387,064

(22) Filed: Apr. 28, 2009

(65) Prior Publication Data

US 2009/0272234 A1 Nov. 5, 2009

Related U.S. Application Data

(60) Provisional application No. 61/050,119, filed on May 2, 2008.

(51) Int. Cl.
*B25B 13/54* (2006.01)

(52) U.S. Cl. ..... 81/57.33; 81/446

(58) Field of Classification Search ..... 81/57.33, 81/446, 52, 53.2, 443; 279/2.19, 2.23; 294/94; 192/45

See application file for complete search history.

(56) References Cited

U.S. PATENT DOCUMENTS

| | | | | |
|---|---|---|---|---|
| 705,724 | A * | 7/1902 | Upson | 81/446 |
| 2,528,873 | A * | 11/1950 | Dorman | 279/2.2 |
| 4,741,228 | A * | 5/1988 | O'Flaherty | 81/53.2 |
| 4,762,187 | A * | 8/1988 | Haney | 175/171 |
| 5,129,291 | A * | 7/1992 | Poniatowski | 81/446 |
| 5,839,330 | A * | 11/1998 | Stokka | 81/57.33 |
| 6,675,679 | B2 * | 1/2004 | Dugan | 81/446 |
| 6,851,342 | B2 * | 2/2005 | Dugan et al. | 81/446 |
| 6,874,393 | B2 * | 4/2005 | Kile | 81/446 |
| 6,904,835 | B2 * | 6/2005 | Dugan et al. | 81/446 |

* cited by examiner

*Primary Examiner* — David B Thomas

(57) ABSTRACT

A spinner tool has a shaft that is receivable in a rotation-imparting device, such as a hand-held drill. The shaft carries mounts in which the shaft rotates. Gripper elements are mounted between the mounts for radial movement relative to the shaft. The shaft is configured to move the gripper elements away from the shaft away from the shaft upon rotation of the shaft. This movement of the gripper elements causes the gripper elements to engage the interior surface of a hollow-cylindrical element in which the tool is inserted, so that the hollow-cylindrical element rotates together with the shaft.

3 Claims, 3 Drawing Sheets

INTERNALLY FITTING TOOL FOR SPINNING A HOLLOW ELEMENT

RELATED APPLICATION

The present application claims the benefit of provisional application 61/050,119 filed on May 2, 2008.

BACKGROUND OF THE INVENTION

1. Field of the Invention

The present invention concerns an arrangement for spinning one hollow element relative to a second hollow element in which the first hollow element engages, such as for spinning one threaded pipe inside another threaded pipe.

2. Description of the Prior Art

Typically when two hollow elements, such as two hollow-cylindrical elements, are to be mechanically engaged with one another, such as when engaging the threads of a pipe that is threaded at one end with the mating threads of another pipe, the pipes are relatively rotated manually, possibly with the assistance of grippers, such as wrenches. This can be difficult to accomplish in certain situations, particularly if the engagement must be done by only one person and if the pipes are relatively cumbersome to align or manipulate.

SUMMARY OF THE INVENTION

It is an object of the present invention to provide an arrangement that allows quick and easy rotation of one hollow-cylindrical element relative to another hollow-cylindrical element in which the first hollow-cylindrical element is to be mechanically engaged.

The above object is achieved in accordance with the present invention by an internally fitting tool that fits inside one hollow-cylindrical element that is to be rotated relative to another hollow-cylindrical element. The tool has a rotatable shaft with a first end configured to engage a rotation-imparting device. A second end of the shaft has actuating surfaces thereon that have a non-circular cross-section in a plane perpendicular to the rotational axis of the shaft. The shaft also carries two parallel plates that are spaced from each other along the length of the shaft, extending from the shaft in respective planes that are perpendicular to the axis of rotation of the shaft. The shaft is rotatable in central openings in each of the plates. Gripping elements are radially slidably mounted between the two plates at radial positions around the periphery of the actuating surfaces. Rotation of the shaft in the openings of the plates causes the actuating surfaces to push the gripping elements radially outwardly, sliding between the parallel plates, so that they project beyond the peripheral edges of the two plates. When the arrangement is placed inside (i.e., within the inner diameter) of a hollow-cylindrical element such as a pipe the projecting grippers frictionally engage the inner surface of the element, causing the element to spin or rotate together with the shaft.

If the element that is caused to spin with the shaft is a pipe that is threaded at one end that is intended to engage threads of another pipe, the first pipe can be spun (rotated) in the manner described above so as to cause the threads to engage tightly.

DESCRIPTION OF THE PREFERRED EMBODIMENTS

Figure 1:
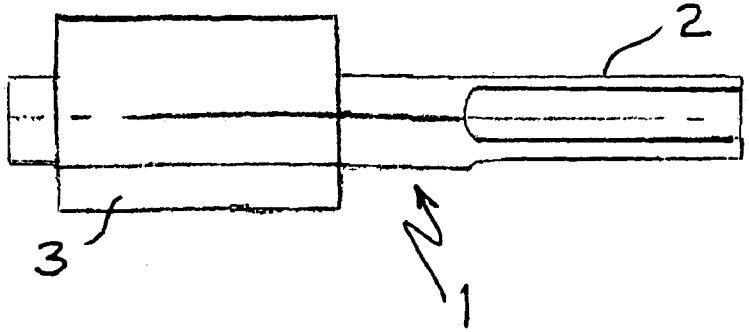
FIG. 1 is a side view of a shaft in the spinner tool according to the invention.

FIG. 1 is a side view of a shaft 1 for use in the spinner tool according to the invention. The shaft 1 has a first end 2 configured to fit into a rotation-imparting device so as to be rotated around the longitudinal axis of the shaft 1. The rotation-imparting device may be, for example, a hand-held drill and the first end 2 may be configured to fit in the chuck of such a hand-held drill.

Figure 2:
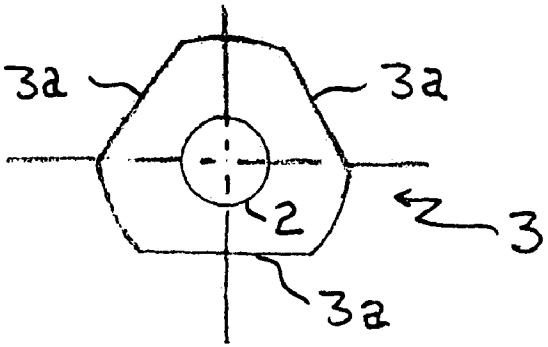
FIG. 2 is a section taken along line II-II of FIG. 1.

The shaft 1 has a second end 3 that has a periphery that is larger than the remainder of the shaft, and that has a non-circular cross-section. In the exemplary embodiment shown in the drawings, the second end 3 has three flat surfaces 3*a*, generally arranged as a triangle, as shown in FIG. 2.

Figure 3:
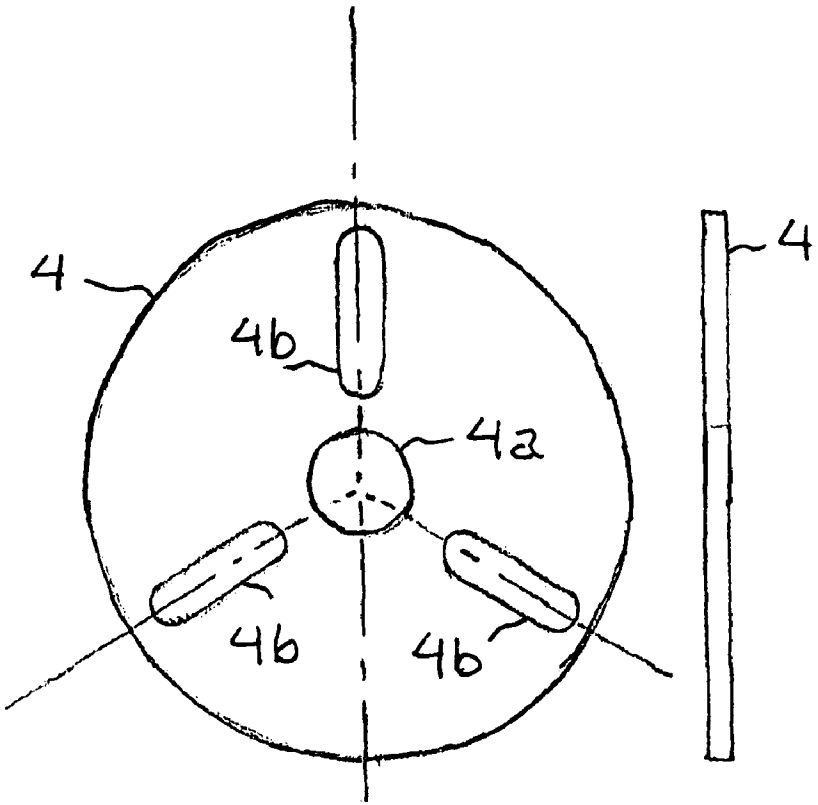
FIG. 3 shows a front view and a side view of one of the plates in the spinner tool according to the invention.

The spinner tool also has two end plates 4, one of which is shown in an end view and in a side view in FIG. 3. Each end plate 4 has a central opening 4*a* therein and several radially-extending slots 4*b* therein. In the exemplary embodiment, three such slots 4*b* are provided. The shaft 1 is received in a bearing at the central opening of one of the end plates that allows the shaft 1 to rotate in that bearing.

Figure 4:
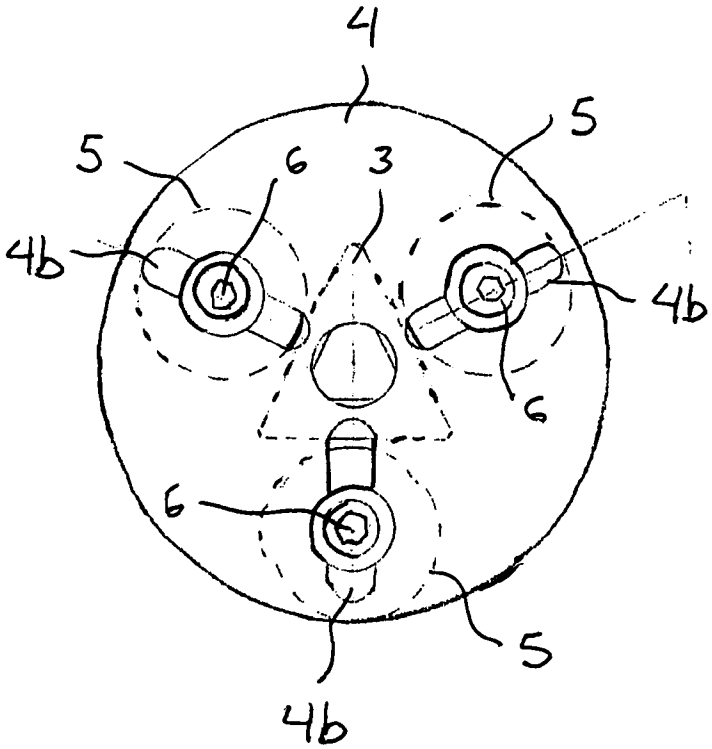
FIG. 4 is an end view of the assembled spinner tool according to the invention.
Figure 5:
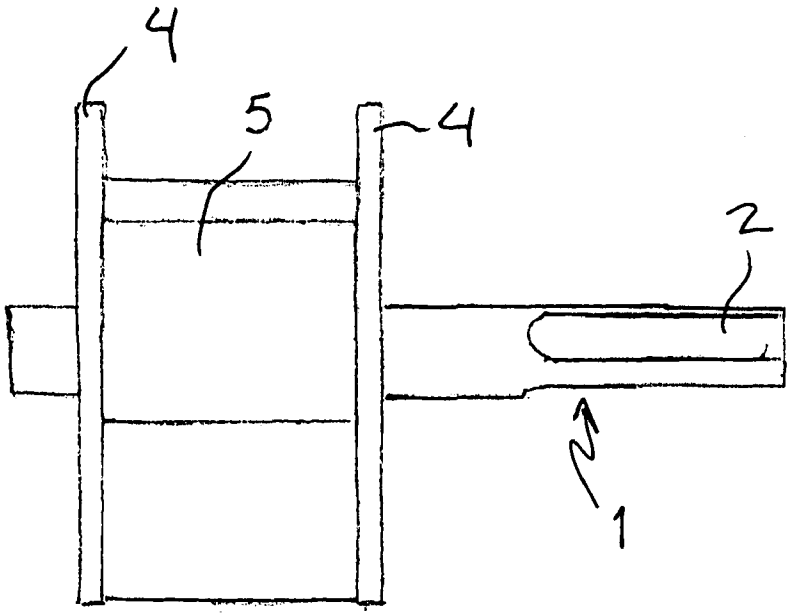
FIG. 5 is a side view of the assembled spinner tool according to the invention.

As shown in FIGS. 4 and 5, three gripper elements 5, such as cylinders or wheels, are mounted so as to slide radially in the slots 4*b*. This is accomplished in the exemplary embodiment by, for each gripper element 5, a bolt 6 that extends through the gripper element 5, parallel to the longitudinal axis of the shaft 1. The bolt 6 has a bolt head adjacent one the plates 4 and the other end is threaded so as to receive a washer and a nut adjacent the other plate 4. As the second end 3 of the shaft 1 is rotated, the surfaces 3*a* thereof, as a result of being non-circular in cross-section, force the gripper elements 5 radially outwardly with the respective bolts 6 sliding in the respective slots 4*b*. This causes the gripper elements 5 to project beyond the periphery of the plates 4.

Figure 6:
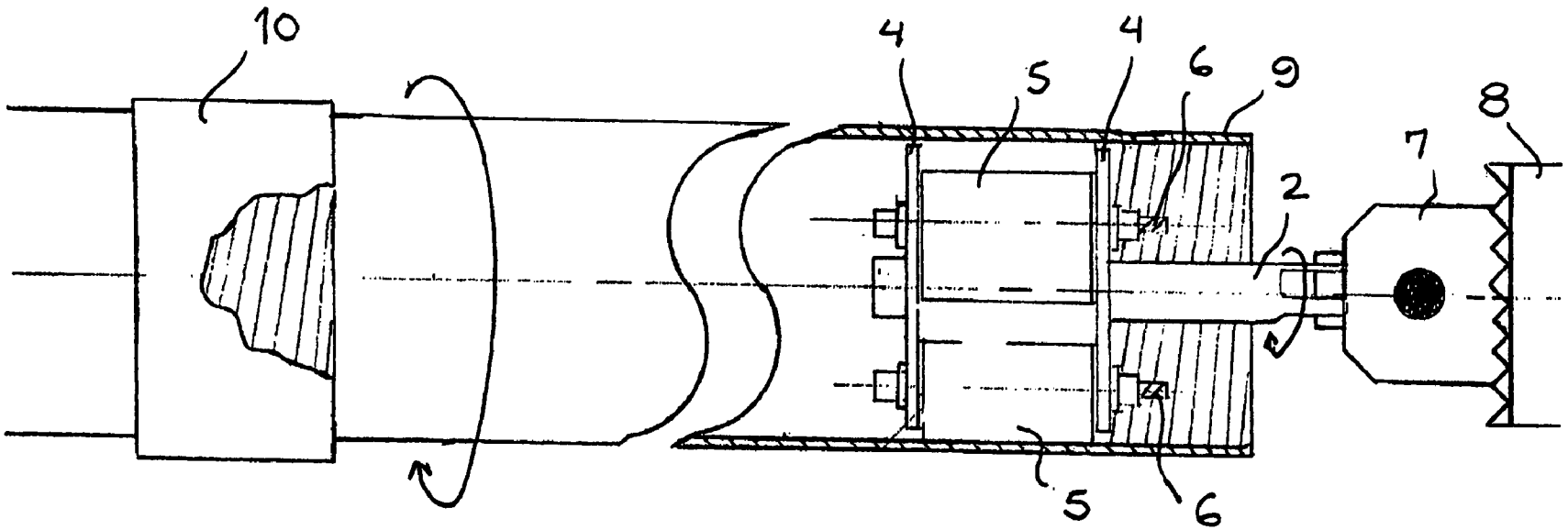
FIG. 6 is a side view of the spinner tool operated by a hand-held drill inside one pipe that is to be threaded into engagement with another pipe.

FIG. 6 shows the arrangement in use. The first end 2 of the shaft 1 is held in the chuck 7 of a hand-held drill 8. The spinner arrangement is shown in the interior of a pipe 9, already engaging the inner surface thereof due to rotation imparted by the hand-held drill 8. The gripper elements 5 are thus forced into frictional engagement with the inner surface of the pipe 9 so that the pipe 9 co-rotates with the spinner arrangement.

In the embodiment, the pipe 9 is intended to be threaded into a coupling 10 of another pipe. This is accomplished in accordance with the present invention by first operating the hand-held drill 8 to engage the spinner arrangement with the pipe 9, and then continuing to operate the hand-held drill 8 so that the pipe 9 is caused to rotate within the threads of the coupling 10 until the pipe 9 is tightly threaded into the coupling 10.

Although the invention has been described in the context of engaging two pipes by threading, the spinner arrangement can be used in general whenever it is necessary to rotate one hollow-cylindrical element relative to another hollow-cylindrical element, for any purpose. Moreover, the drive-imparting unit can be operated in reverse to disengage, or assist in disengaging, one hollow-cylindrical element from another.

Although modifications and changes may be suggested by those of ordinary skill in the art, it is the intention of the inventor to embody within the patent warranted hereon, all changes and modifications as reasonably and properly come within the scope of his contribution to the art.

I claim as my invention:

1. A spinner tool comprising:

a shaft having a first end configured to engage a rotation-imparting device to allow the shaft to be rotated around a longitudinal axis of the shaft;

said shaft having a second end with surfaces forming a non-circular cross-section in a plane perpendicular to said longitudinal axis;

two parallel plates carried by said shaft and extending in respective planes perpendicular to said longitudinal axis, each plate having a central opening therein through which said shaft proceeds and rotates, and each plate having a periphery and a plurality of slots therein, each of said slots proceeding exclusively radially between a first slot end next to said central opening and a second slot end next to said periphery;

a plurality of cylindrical gripper elements disposed around said second end of said shaft, each mounted to and between said plates for radial movement relative to said longitudinal axis by pins respectively riding in said slots;

said surfaces of said second end of said shaft respectively coming into direct contact with each of said cylindrical gripper elements upon rotation of said shaft to push said cylindrical gripper elements exclusively radially outwardly from said longitudinal axis between said plates; and each of said cylindrical gripper elements having a size in a plane perpendicular to said longitudinal axis that causes each of said cylindrical gripper elements to be within the respective peripheries of said plates when said shaft is in a first rotational position, due to said pins being respectively located adjacent said first slot ends and to project beyond the respective peripheries of said plates when said shaft is rotated to a second rotational position due to said pins being respectively located adjacent said second slot ends.

2. A spinner tool as claimed in claim 1 wherein said plates and said gripper elements each have a size allowing said plates and said gripper elements to fit inside a hollow-cylindrical element and to cause said gripper elements to tangentially, frictionally engage an interior surface of the hollow-cylindrical element upon rotation of said shaft to cause the hollow-cylindrical element to be rotated by said shaft.

3. A spinner tool as claimed in claim 1 comprising three of said gripper elements, and wherein said second end of said shaft has three surfaces forming respective portions of sides of a triangle.

* * * * *